US011459790B1

(12) United States Patent
Franchini et al.

(10) Patent No.: US 11,459,790 B1
(45) Date of Patent: Oct. 4, 2022

(54) LANDSCAPE BARRIER AND METHOD TO MANUFACTURE AND INSTALL THE SAME

(71) Applicant: ET Edge Line LLC, Medina, OH (US)

(72) Inventors: Edward Franchini, North Randall, OH (US); Thomas Punchak, Medina, OH (US)

(73) Assignee: ET Edge Line LLC, Medina, OH (US)

( * ) Notice: Subject to any disclaimer, the term of this patent is extended or adjusted under 35 U.S.C. 154(b) by 142 days.

(21) Appl. No.: 16/775,685

(22) Filed: Jan. 29, 2020

Related U.S. Application Data

(60) Provisional application No. 62/799,467, filed on Jan. 31, 2019.

(51) Int. Cl.
*E04H 7/06* (2006.01)
*E04H 17/06* (2006.01)

(52) U.S. Cl.
CPC ..... *E04H 17/063* (2013.01)

(58) Field of Classification Search
CPC ..... E04H 17/06; E04H 17/063; A01G 9/28
USPC ..... 256/1; 405/107, 114, 284; 52/102; 47/33
See application file for complete search history.

(56) References Cited

U.S. PATENT DOCUMENTS 3,393,897 A * 7/1968 Wright ..... E04H 17/063 256/32
3,452,495 A * 7/1969 Schroeder ..... E04H 4/141 52/102
3,515,373 A * 6/1970 Abbe ..... A01G 9/28 256/32
3,520,082 A * 7/1970 Smith ..... A01G 9/28 47/33
3,676,952 A * 7/1972 Watts ..... A01G 9/28 47/33
3,713,624 A * 1/1973 Niemann ..... E04H 17/063 256/32
3,724,128 A * 4/1973 Tabone ..... A01G 9/28 47/33
3,777,421 A * 12/1973 Bomba ..... A01G 9/28 47/33
3,788,001 A * 1/1974 Balfanz, Jr. ..... A01G 9/28 47/33
3,945,747 A * 3/1976 Cruz ..... E01F 15/025 404/7
4,478,391 A * 10/1984 Kovach ..... E04H 17/063 256/1
4,508,319 A * 4/1985 Tappan ..... E04H 17/14 256/1

(Continued)

FOREIGN PATENT DOCUMENTS

DE 3127920 A1 * 1/1983 ..... A01G 9/28
DE 102008004035 A1 * 7/2009 ..... E04H 17/063

*Primary Examiner* — Michael P Ferguson
(74) *Attorney, Agent, or Firm* — Edwin A. Sisson, Attorney at Law, LLC; Jeffrey J. Banyas

(57) ABSTRACT

A landscaping barrier comprises a first longitudinal member, a second longitudinal member and a third longitudinal member. The second longitudinal member may be attached to and extend substantially perpendicular from one edge of the first longitudinal member while the third longitudinal member may be attached to and extend substantially perpendicular from the opposite edge of the first longitudinal member and in the opposite direction of the second longitudinal member.

11 Claims, 7 Drawing Sheets

(56) References Cited

U.S. PATENT DOCUMENTS

| | | | | | |
|---|---|---|---|---|---|
| 4,515,349 | A * | 5/1985 | Groves | E04H 17/063 | 256/32 |
| 4,548,388 | A * | 10/1985 | Cobler | E04H 17/063 | 256/1 |
| 4,690,382 | A * | 9/1987 | Koperdak | E04H 17/063 | 256/1 |
| 4,903,947 | A * | 2/1990 | Groves | A01G 9/28 | 256/32 |
| 4,964,619 | A * | 10/1990 | Glidden, Jr. | E04H 17/063 | 256/32 |
| 4,969,289 | A * | 11/1990 | Trifiletti | A01G 9/28 | 47/33 |
| 5,092,076 | A * | 3/1992 | Terreta | A01G 9/28 | 47/33 |
| 5,121,569 | A * | 6/1992 | Thomas | A01G 9/28 | 47/33 |
| 5,544,445 | A * | 8/1996 | Mantilla | A01G 9/28 | 47/33 |
| 5,997,213 | A * | 12/1999 | Dennis | E02B 13/02 | 405/107 |
| 6,070,859 | A * | 6/2000 | Damon | E04H 17/063 | 256/1 |
| 6,385,898 | B1 * | 5/2002 | Noel | A01G 9/28 | 47/33 |
| 6,505,819 | B1 * | 1/2003 | Damon | E04H 17/063 | 256/1 |
| 6,561,491 | B2 | 5/2003 | Thompson et al. | | |
| 7,887,027 | B2 * | 2/2011 | Garceau | E04H 17/066 | 256/1 |
| D732,700 | S | 6/2015 | Bill | | |
| 9,468,151 | B2 * | 10/2016 | Webber | A01G 9/28 | |
| 2015/0021531 | A1 | 1/2015 | Raab | | |

* cited by examiner

LANDSCAPE BARRIER AND METHOD TO MANUFACTURE AND INSTALL THE SAME

CROSS REFERENCES AND PRIORITIES

This Applications claims priority from U.S. Provisional Application No. 62/799,467 filed on 31 Jan. 2019 the teachings of which are incorporated by reference herein in their entirety.

BACKGROUND

Commercial, industrial, and residential property owners often erect fences to define property boundaries, restrict movement of people and/or animals, protect privacy, or for various other decorative and/or functional reasons. Common fences include a series fence post which are secured into the ground with a fencing material such as chain link fencing or wooden boards spanning the distance between each fence post.

Trimming grass, weeds, and other vegetation along the base of a fence can be difficult and time consuming. Most lawn mowers cannot access vegetation that grows along or underneath the fence line. This may require the use of more labor intensive techniques such as spraying of herbicides and/or the use of power tools like weed whackers to keep the fence line clear of overgrown vegetation. This can be particularly problematic for properties having extensive fencing installations such as airports, warehouses, correctional institutions, and industrial facilities.

Other issues presented by fence lines include animals and/or people tunneling underneath the fence, and run-off from chemicals used on the property spilling past the fence line.

Many solutions have been proposed for solving these common fencing problems. The simplest solutions involve a length of material having an "L" shaped cross section as shown in U.S. Pat. Nos. 3,713,624, 4,548,388, and 6,561,491. In these solutions, one section of the "L" lays flat along the ground while the other section of the "L" extends up a portion of the fencing material. The section along the ground may be secured to the ground by various nails or stakes, while the section along the fence may be secured to the fence by a variety of fasteners.

In practice, the "L" shaped solutions suffer from a number of problems. First, the nails or stakes which secure the material to the ground can loosen due to the effects of soil erosion, or can be intentionally removed. This may allow the section extending along the ground to fold up away from the ground, allowing vegetation growth underneath. Second, these solutions are ineffective for deterring or preventing animals and/or people from tunneling underneath the fence. Finally, these solutions are ineffective for reducing or preventing chemical run-off in the sub-surface soil.

The need exists, therefore, for an improved landscaping barrier which reduces or prevents vegetation growth along the fence line, deters tunneling by animals and/or people, and limits the effects of chemical run-off in the sub-surface soil.

SUMMARY

A landscaping barrier is disclosed herein. The landscaping barrier may comprise a first longitudinal member, a second longitudinal member, and a third longitudinal member.

The first longitudinal member may have a first longitudinal member length dimension, a first longitudinal member width dimension, and at least four first longitudinal member edges. The second longitudinal member may have a second longitudinal member length dimension, a second longitudinal member width dimension, and at least four second longitudinal member edges. The third longitudinal member may have a third longitudinal member length dimension, a third longitudinal member width dimension, and at least four third longitudinal member edges.

A first edge of the second longitudinal member may be attached to and extend substantially perpendicular from a third edge of the first longitudinal member. A third edge of the third longitudinal member may be attached to and extend substantially perpendicular from a first edge of the first longitudinal member which is opposite of the third edge of the first longitudinal member. The third longitudinal member may extend in the opposite direction of the second longitudinal member.

In some embodiments, there may be a first bend angle ($\omega_1$) between the first longitudinal member and the second longitudinal member. The first bend angle may be in a range of between 70° and 110°. In certain embodiments, there may be a second bend angle ($\omega_2$) between the first longitudinal member and the third longitudinal member. The second bend angle may be in a range of between 70° and 110°.

In some embodiments, the landscaping barrier may further comprise an anchor attached to and extending from a first edge of the third longitudinal member. The anchor may comprise a plurality of anchor members spaced intermittently along a portion of the first edge of the third longitudinal member. Alternatively, the anchor may extend along the entire first edge of the third longitudinal member.

In some embodiments, the first longitudinal member may comprise at least one fence post hole located adjacent to the third edge of the first longitudinal member, and the second longitudinal member may comprise at least one cut-out running from the second longitudinal member first edge to the second longitudinal member third edge with each cut-out located proximate to one fence post hole.

The landscaping barrier may be comprised of a material selected from the group consisting of polymers, rubbers, and fiber mats. In some embodiments, the material may comprise a UV blocker.

Also disclosed is a method of installing a landscaping barrier comprising a first longitudinal member, a second longitudinal member, and a third longitudinal member along an edge of a structure. The method may comprise a first step of digging a trench parallel to the structure at a distance from the structure substantially equal to a first longitudinal member width dimension. The method of installing may comprise a second step of inserting the third longitudinal member into the trench. The method of installing may comprise a third step of placing the first longitudinal member along a ground surface spanning the distance from the trench to the structure. The method of installing may comprise a fourth step of placing the second longitudinal member along a bottom portion of the structure. The method of installing may comprise a fifth step of securing the second longitudinal member to the bottom portion of the structure using a plurality of fasteners. Finally, the method of installing may comprise a sixth step of filling the trench with a filling material.

In the method of installing a landscaping barrier, the third longitudinal member may have a third longitudinal member width dimension and a third longitudinal member thickness. The trench may be dug to a trench depth which is greater than or equal to the third longitudinal member width dimension, and a trench width which is greater than or equal to the third longitudinal member thickness.

In some embodiments of the method of installing a landscaping barrier, the third longitudinal member may further comprise an anchor attached to and extending from a first edge of the third longitudinal member.

Each fastener of the plurality of fasteners may independently be selected from the group consisting of a wire, a cable tie, a nut and bolt, a screw, a rivet, and a staple.

The filling material may be selected from the group consisting of dirt, sand, gravel, asphalt, concrete, or combinations thereof.

The structure may be selected from the group consisting of a fence, a wall of a commercial building, a wall of a residential building, a wall of an industrial building, a retaining wall, a landscaping bed, and combinations thereof.

DETAILED DESCRIPTION

Disclosed herein is a landscaping barrier, a method of manufacturing a landscaping barrier, and a method of installing a landscaping barrier. As described herein and in the claims, the following numbers refer to the following structures as noted in the Figures.

10 refers to a landscaping barrier.
20 refers to a fence post.
30 refers to a fence.
40 refers to a distance from the fence.
50 refers to a ground surface.
70 refers to a trench.
75 refers to a trench depth.
77 refers to a trench width.
100 refers to a first longitudinal member.
110 refers to a first longitudinal member length dimension.
120 refers to a first longitudinal member width dimension.
130 refers to a first edge of the first longitudinal member.
140 refers to a second edge of the first longitudinal member.
150 refers to a third edge of the first longitudinal member.
160 refers to a fourth edge of the first longitudinal member.
170 refers to a first longitudinal member top side.
180 refers to a first longitudinal member bottom side.
200 refers to a second longitudinal member.
210 refers to a second longitudinal member length dimension.
220 refers to a second longitudinal member width dimension.
230 refers to a first edge of the second longitudinal member.
240 refers to a second edge of the second longitudinal member.
250 refers to a third edge of the second longitudinal member.
260 refers to a fourth edge of the second longitudinal member.
270 refers to a second longitudinal member top side.
280 refers to a second longitudinal member bottom side.
300 refers to a third longitudinal member.
310 refers to a third longitudinal member length dimension.
320 refers to a third longitudinal member width dimension.
330 refers to a first edge of the third longitudinal member.
340 refers to a second edge of the third longitudinal member.
350 refers to a third edge of the third longitudinal member.
360 refers to a fourth edge of the third longitudinal member.
370 refers to a third longitudinal member top side.
380 refers to a third longitudinal member bottom side.
400 refers to an anchor.

Figure 1:
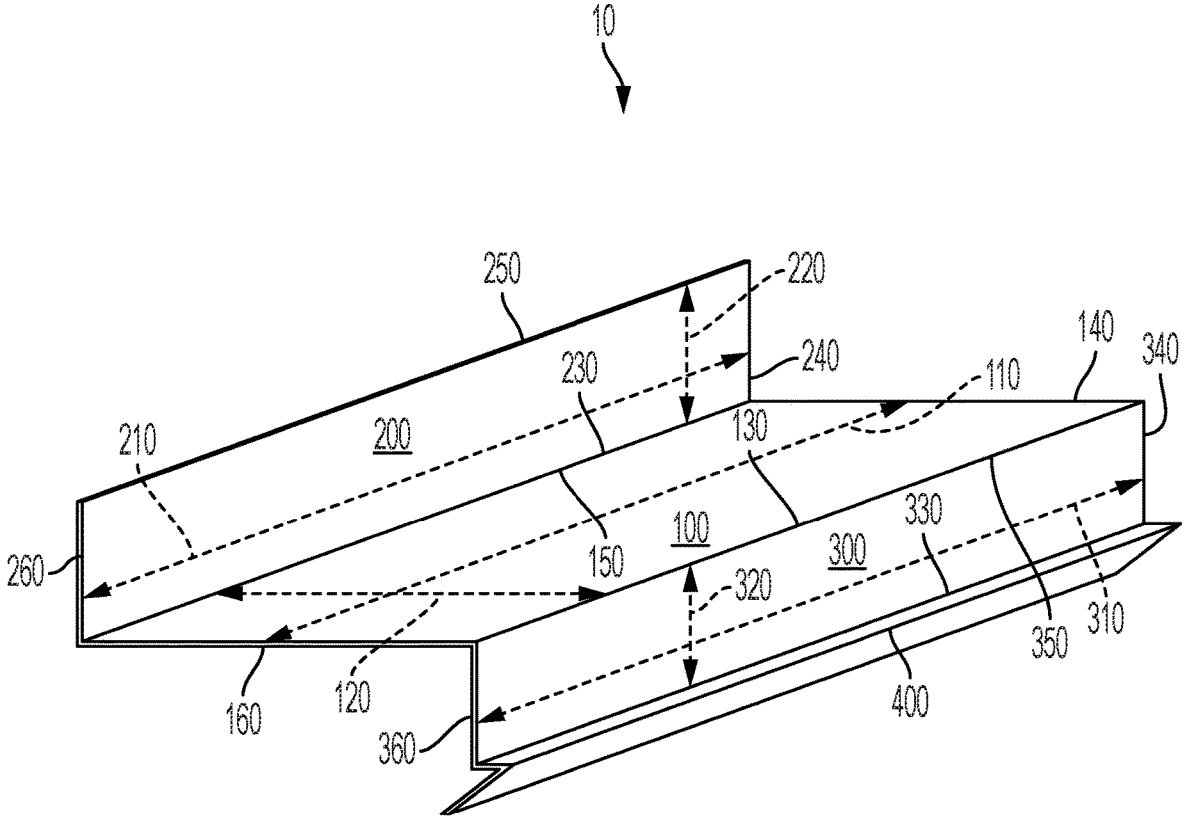
FIG. 1 is a perspective view of one embodiment of a landscaping barrier as described herein.

FIG. 1 depicts a perspective view of one embodiment of a landscaping barrier (10). As shown in FIG. 1, the landscaping barrier may comprise a first longitudinal member (100), a second longitudinal member (200), and a third longitudinal member (300). In some embodiments, the landscaping barrier may also comprise an anchor (400) as shown in FIG. 1, although the anchor is not considered an essential element and may be excluded in some embodiments.

Figure 4:
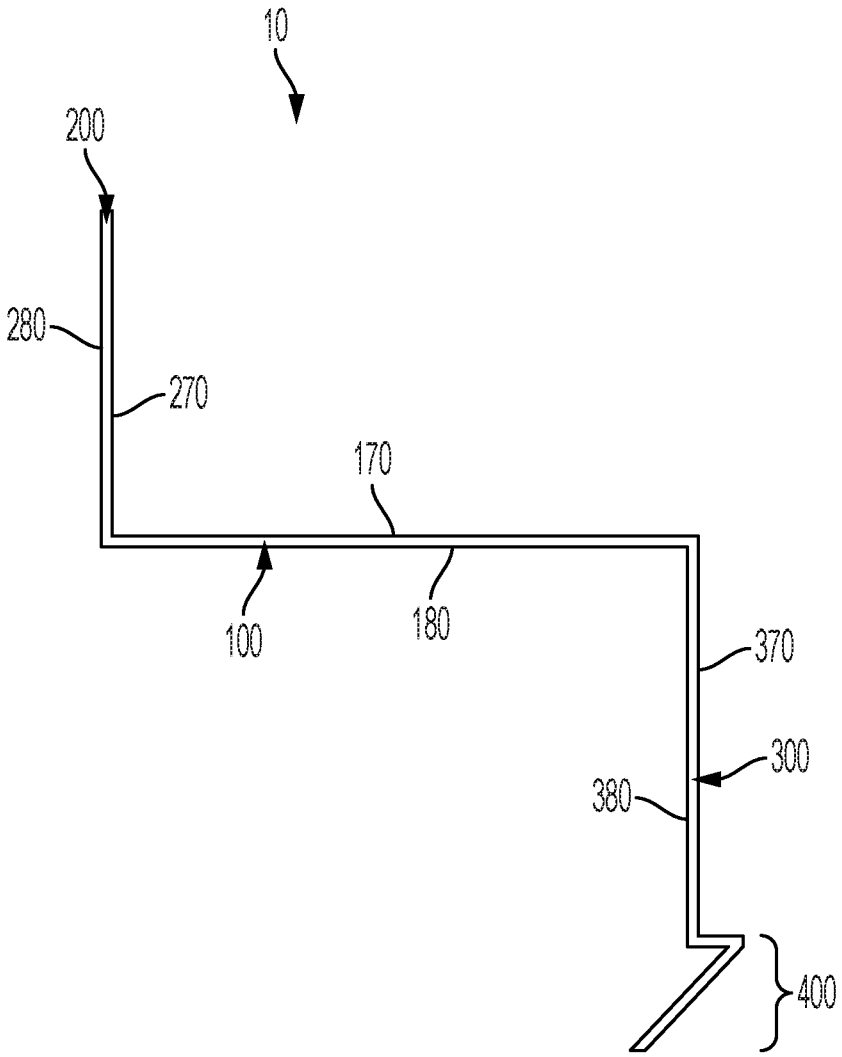
FIG. 4 is a side view of the embodiment of a landscaping barrier shown in FIG. 1.

The first longitudinal member (100) may have a first longitudinal member length dimension (110), and a first longitudinal member width dimension (120). The first longitudinal member length dimension and first longitudinal member width dimension will define a first longitudinal member plane having a first longitudinal member top side (170 as shown in FIG. 4) and a first longitudinal member bottom side (180 as shown in FIG. 4) opposite the first longitudinal member top side. Preferably, the first longitudinal member plane will have a shape which is substantially rectangular having at least four first longitudinal member edges. The at least four first longitudinal member edges may be defined as a first edge of the first longitudinal member (130), a second edge of the first longitudinal member (140) which is attached to and extends substantially perpendicular from the first edge of the first longitudinal member, a third edge of the first longitudinal member (150) which is attached to and extends substantially perpendicular from the second edge of the first longitudinal member, and a fourth edge of the first longitudinal member (160) which is attached to and extends substantially perpendicular from the third edge of the first longitudinal member. When the first longitudinal member has a substantially rectangular shape, the first edge of the first longitudinal member and the third edge of the first longitudinal member will be substantially parallel to one another, while the second edge of the first longitudinal member and the fourth edge of the first longitudinal member are also substantially parallel to one another.

The second longitudinal member (200) may have a second longitudinal member length dimension (210), and a second longitudinal member width dimension (220). The second longitudinal member length dimension and second longitudinal member width dimension will define a second longitudinal member plane having a second longitudinal member top side (270 as shown in FIG. 4) and a second longitudinal member bottom side (280 as shown in FIG. 4) opposite the second longitudinal member top side. Preferably, the second longitudinal member plane will have a shape which is substantially rectangular having at least four second longitudinal member edges. The at least four second longitudinal member edges may be defined as a first edge of the second longitudinal member (230), a second edge of the second longitudinal member (240) which is attached to and extends substantially perpendicular from the first edge of the second longitudinal member, a third edge of the second longitudinal member (250) which is attached to and extends substantially perpendicular from the second edge of the second longitudinal member, and a fourth edge of the second longitudinal member (260) which is attached to and extends substantially perpendicular from the third edge of the second longitudinal member. When the second longitudinal member has a substantially rectangular shape, the first edge of the second longitudinal member and the third edge of the second longitudinal member will be substantially parallel to one another, while the second edge of the second longitudinal member and the fourth edge of the second longitudinal member are also substantially parallel to one another.

The third longitudinal member (300) may have a third longitudinal member length dimension (310), and a third longitudinal member width dimension (320). The third longitudinal member length dimension and third longitudinal member width dimension will define a third longitudinal member plane having a third longitudinal member top side (370 as shown in FIG. 4) and a third longitudinal member bottom side (380 as shown in FIG. 4) opposite the third longitudinal member top side. Preferably, the third longitudinal member plane will have a shape which is substantially rectangular having at least four third longitudinal member edges. The at least four third longitudinal member edges may be defined as a first edge of the third longitudinal member (330), a second edge of the third longitudinal member (340) which is attached to and extends substantially perpendicular from the first edge of the third longitudinal member, a third edge of the third longitudinal member (350) which is attached to and extends substantially perpendicular from the second edge of the third longitudinal member, and a fourth edge of the third longitudinal member (360) which is attached to and extends substantially perpendicular from the third edge of the third longitudinal member. When the third longitudinal member has a substantially rectangular shape, the first edge of the third longitudinal member and the third edge of the third longitudinal member will be substantially parallel to one another, while the second edge of the third longitudinal member and the fourth edge of the third longitudinal member are also substantially parallel to one another.

While FIG. 1 shows the third longitudinal member (300) extending along the entire length of the first longitudinal member first edge (130), embodiments may exist in which there are a plurality of third longitudinal members spaced intermittently along the length of the first longitudinal member first edge. In such embodiments, each third longitudinal member of the plurality of third longitudinal members may independently have its own length dimension and width dimension.

As shown in FIG. 1, the first longitudinal member (100) and the second longitudinal member (200) may be attached to one another. This may be accomplished by having the first edge of the second longitudinal member (230) attached to the third edge of the first longitudinal member (150). Preferably, the second longitudinal member will extend perpendicular or substantially perpendicular from the third edge of the first longitudinal member.

As also shown in FIG. 1, the first longitudinal member (100) and the third longitudinal member (300) may be attached to one another. This may be accomplished by having the third edge of the third longitudinal member (350) attached to the first edge of the first longitudinal member (130). Preferably, the third longitudinal member will extend perpendicular or substantially perpendicular from the first edge of the first longitudinal member. As shown in FIG. 1, the third longitudinal member may extend in the opposite direction of the second longitudinal member.

The attachment between the first longitudinal member and the second longitudinal member, as well as the attachment between the first longitudinal member and the third longitudinal member may be any type of permanent or non-permanent attachment. Examples of permanent attachments include melt bonding, welding, or manufacturing two members of one integral piece of material. Non-permanent attachments typically involve the use of fasteners such as wires, cable ties, screws, nails, nuts and bolts, staples, or the like.

FIG. 1 also shows an optional anchor (400). The anchor, when used, may be attached to and extend from the first edge of the third longitudinal member (330). While the anchor can take many configurations, it is preferred that the anchor provide at least one surface which is not parallel to the third longitudinal member. One example of an anchor is a hook, such as shown in FIG. 1. Other examples of an anchor include an arrow head with the point of the arrow head facing away from the first edge of the third longitudinal member, and a knuckle attached to the first edge of the third longitudinal member.

In some embodiments, the anchor may extend along the entire first edge of the third longitudinal member as shown in FIG. 1. In alternative embodiments (not shown), the anchor may comprise a plurality of anchor members spaced intermittently along a portion of the first edge of the third longitudinal member.

Figure 2:
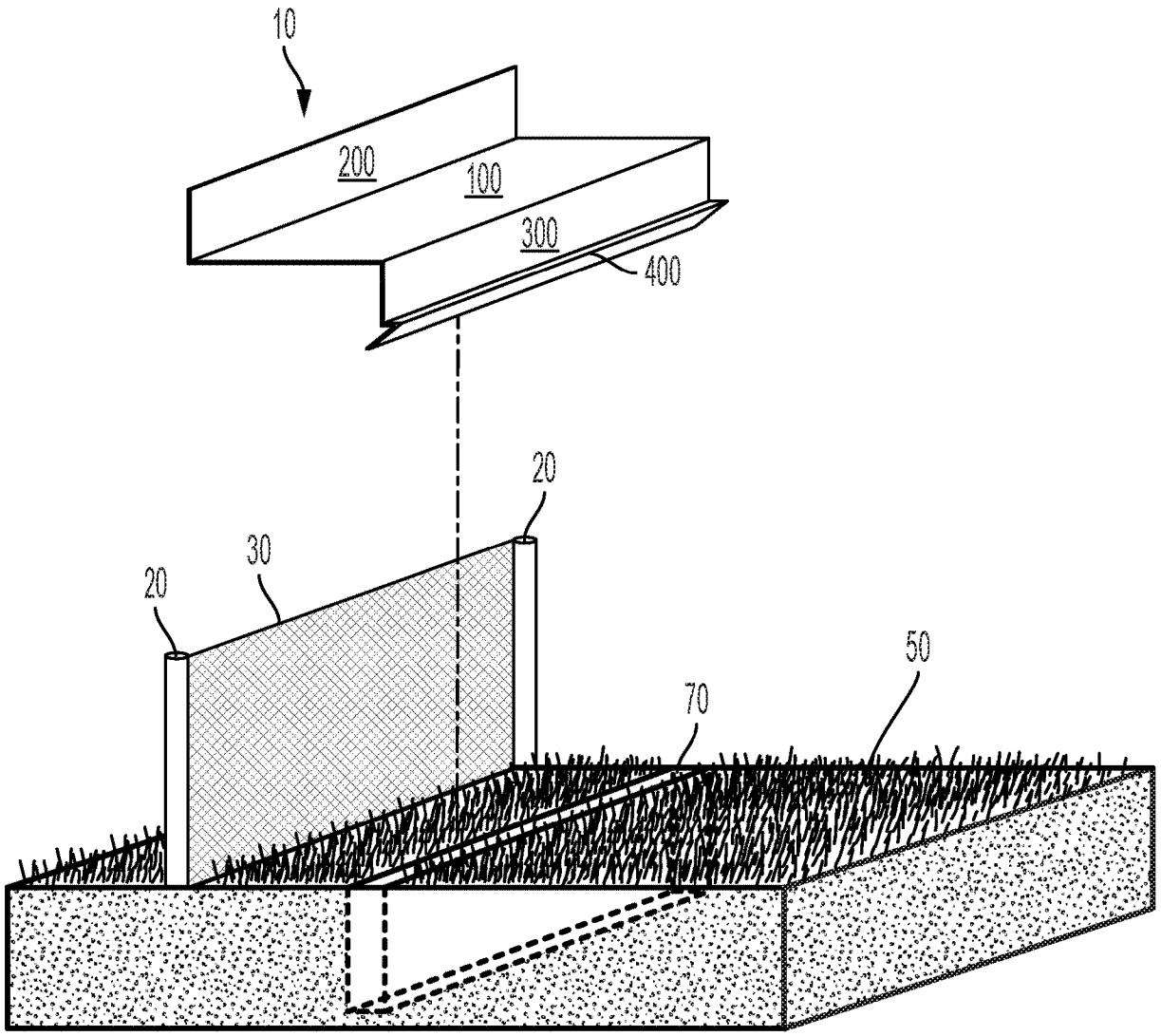
FIG. 2 is a perspective view of one embodiment of installation of a landscaping barrier as described herein.

FIG. 2 depicts a landscaping barrier (10) prepared for installation. As depicted in FIG. 2, the second longitudinal member (200) may be aligned to extend vertically along the bottom edge of a fence (30) with the second longitudinal member bottom side (280 as shown in FIG. 4) facing the fence. While the fence depicted in FIG. 2 is of a chain link variety having a plurality of fence posts (20) connected by chain link fencing, one of ordinary skill will recognize that the landscaping barrier may be used with a variety of different types of fences.

While the second longitudinal member (200) may be aligned to extend vertically along the bottom edge of a fence (30), the first longitudinal member may be aligned to extend away from the fence along a ground surface (50) with the first longitudinal member bottom side (180) facing the ground surface. While the ground surface depicted in FIG. 2 comprises a grass surface, one of ordinary skill will recognize that the ground surface may comprise any number of surfaces including a dirt surface, a stone surface, or a paved surface.

Figure 5:
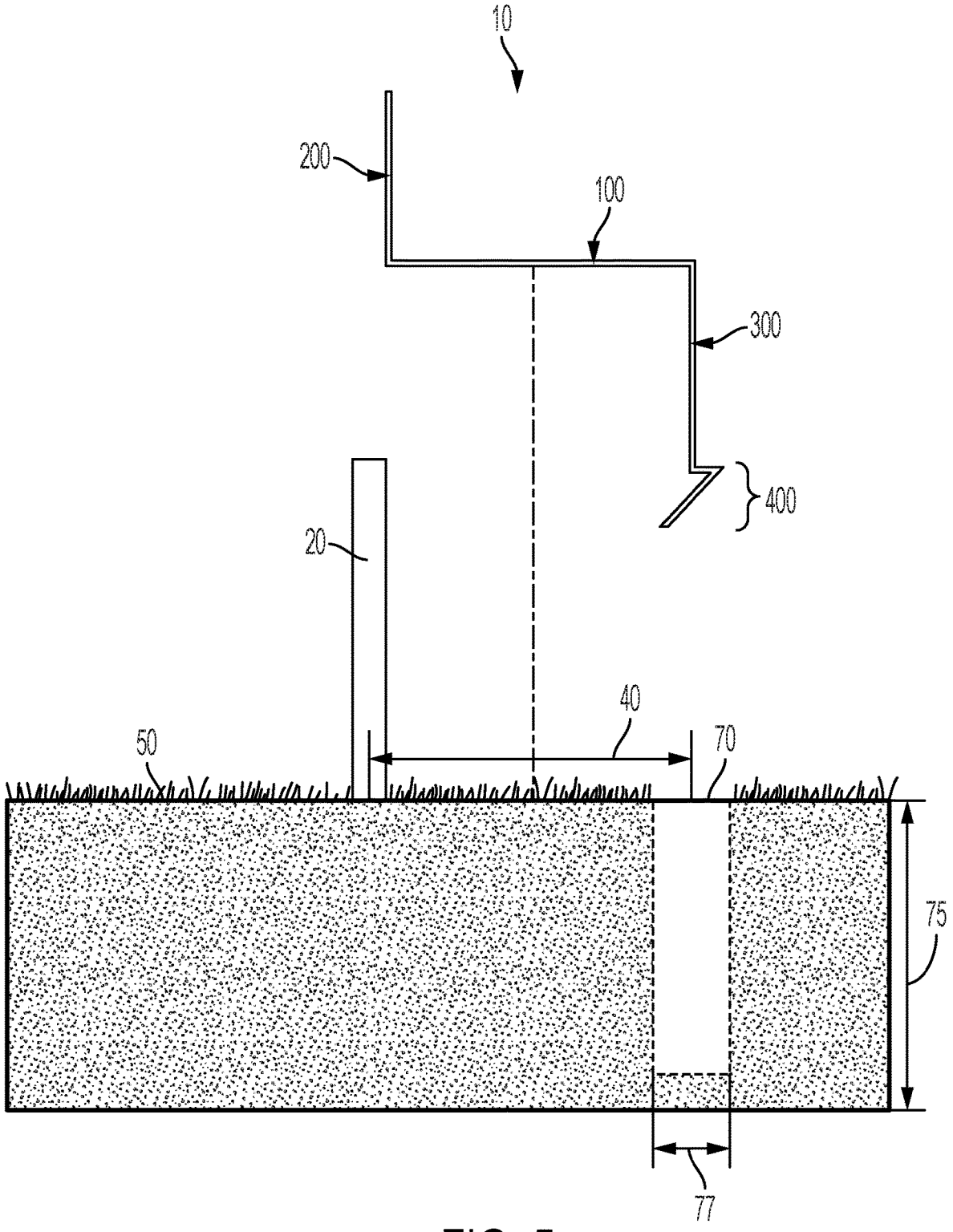
FIG. 5 is a side view of the embodiment of installation of a landscaping barrier shown in FIG. 2.

The third longitudinal member (300) may be aligned to extend vertically into a trench (70) which has been dug into the ground at a distance from the fence (40 as shown in FIG. 5) approximately corresponding to the first longitudinal member width dimension (120). For example, if the first longitudinal member width dimension is three feet (3 ft.), the trench should run substantially parallel to the fence at a distance from the fence of approximately 3 feet (3 ft.). The distance from the fence should be measured from the fence surface to which the second longitudinal member is disposed against to the edge of the trench corresponding to the third longitudinal member bottom side. The trench is preferably dug to a trench depth (75 as shown in FIG. 5) which is equal to or greater than the third longitudinal member width dimension (320). For example, if the third longitudinal member width dimension is two feet (2 ft.), the trench should be dug to a trench depth with is at least two feet (2 ft.). The trench width (77 as shown in FIG. 5) is preferably equal to or greater than the thickness of the material from which the third longitudinal member is constructed.

Figure 3:
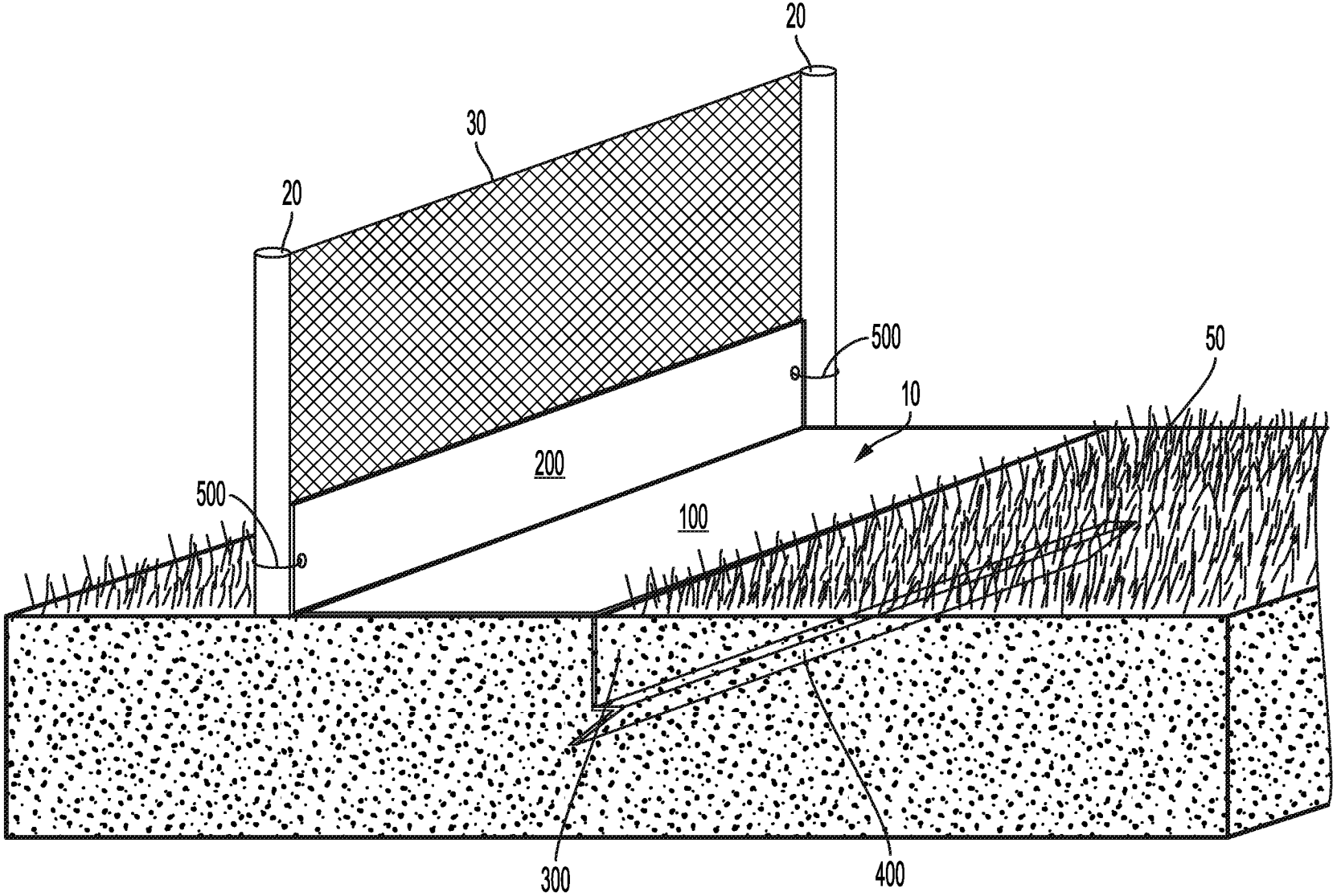
FIG. 3 is a perspective view of one embodiment of an installed landscaping barrier as described herein.

FIG. 3 depicts the landscaping barrier (10) as it is installed. As shown in FIG. 3, the second longitudinal member (200) is disposed along the bottom portion of the fence (30) while the first longitudinal member (100) is disposed over top of the ground surface (50) and the third longitudinal member (300) is disposed into the trench. Once the third longitudinal member is disposed into the trench, the trench may be re-filled with a material as shown in FIG. 3. The material may be selected from the group consisting of dirt, sand, gravel, asphalt, concrete, or combinations thereof.

As shown in FIG. 3, the optional anchor (400) may be utilized to limit the landscaping barrier's vertical movement once the trench has been re-filled with material. By having at least one surface which is not parallel to the third longitudinal member, the anchor may be covered by material when the trench is re-filled, thereby limiting the vertical movement of the third longitudinal member.

In some embodiments, prior to re-filling the trench (70), the landscaping barrier (10) may be further affixed to the ground by passing a plurality of nails and/or a plurality of stakes through the landscaping barrier and into the ground. Each individual nail and/or each individual stake may individually pass through one of the first longitudinal member (100) or the third longitudinal member (300). In some embodiments, there may only be nails and/or stakes passing through the first longitudinal member. In other embodiments, there may only be nails and/or stakes passing through the third longitudinal member. In still other embodiments, there may be individual nails and/or stakes passing through the first longitudinal member, and separate individual nails and/or stakes passing through the third longitudinal member. When there are nails and/or stakes passing through the first longitudinal member it is preferred that each nail and/or stake pass from the first longitudinal member top side (170) through the first longitudinal member plane and extend past the first longitudinal member bottom side (180) into the ground. When there are nails and/or stakes passing through the third longitudinal member, each nail and/or stake may pass from the third longitudinal member top side (370) through the third longitudinal member plane and extend past the third longitudinal member bottom side (380) into the ground, or each nail and/or stake may pass from the third longitudinal member bottom side through the third longitudinal member plane and extend past the third longitudinal member top side into the ground.

Once installed, the second longitudinal member (200) may be affixed to the fence (30) by any number of affixing means known in the art, and those yet to be invented. Examples of affixing means include wires, cable ties, nuts and bolts, screws, rivets, and staples.

In some embodiments (not shown), the first longitudinal member may include at least one fence post hole passing from the first longitudinal member top side (170) through the first longitudinal member plane to the first longitudinal member bottom side (180). When present, the fence post hole(s) are preferably located proximate to the third edge of the first longitudinal member (150). Each fence post hole will have a center point. When there is more than one fence post hole, the center point of a first fence post hole and the center point of a second fence post hole may be separated by a distance which is approximately equal to the distance between the center point of a first fence post and the center point of a second fence post when the landscaping barrier is installed. Each fence post hole may also have a diameter which is at least 0.01 inches greater than the diameter of a corresponding fence post such that the corresponding fence post fits through the fence post hole.

When at least one fence post hole is present, there may also be at least one-cut out in the second longitudinal member. Each cut out will pass from the second longitudinal member top side through the second longitudinal member plane and the second longitudinal member bottom side, and will run from the second longitudinal member first edge to the second longitudinal member third edge. Each cut-out will be located proximate to one fence post hole. For instance, if there are three fence post holes, there will be three corresponding cut-outs with each cut-out located proximate to one of the fence post holes. Preferably, each cut-out will have a cut-out width dimension which is substantially equal to a diameter of a corresponding fence-post hole.

The fence-post hole(s) and/or the cut-out(s) may be factory installed during the process of manufacturing the landscaping barrier, or they may be field installed. One method of installing the fence-post hole(s) and/or the cut-out(s) uses a hole saw and a drill press.

FIG. 4 depicts a side view of a landscaping barrier (10). As shown in the side view of FIG. 4, the landscaping barrier may comprise the first longitudinal member (100), the second longitudinal member (200), and the third longitudinal member (300). The first longitudinal member may comprise a first longitudinal member top side (170) and a first longitudinal member bottom side (180) opposite the first longitudinal member top side. Similarly, the second longitudinal member may comprise a second longitudinal member top side (270) and a second longitudinal member bottom side (280) opposite the second longitudinal member top side. Finally, the third longitudinal member may comprise a third longitudinal member top side (370) and a third longitudinal member bottom side (380).

FIG. 5 depicts a side view of a landscaping barrier (10) prepared for installation. As shown in FIG. 5, the second longitudinal member (200) may be aligned to extend vertically along the bottom edge of the fence (30) with the second longitudinal member bottom side (280 as shown in FIG. 4) facing the fence. The first longitudinal member (100) may be aligned to extend away from the fence along a ground surface (50) with the first longitudinal member bottom side (180 as shown in FIG. 4) facing the ground surface. Finally, the third longitudinal member (300) may be aligned to extend vertically into the trench (70) which has been dug into the ground at a distance from the fence (40) approximately corresponding to the first longitudinal member width dimension (120).

FIG. 5 also depicts the trench depth (75) and the trench width (77). As described herein, the trench depth is preferably equal to or greater than the third longitudinal member width dimension (320 as shown in FIG. 1). The trench width is preferably equal to or greater than the thickness of the material from which the third longitudinal member is constructed.

Figure 6:
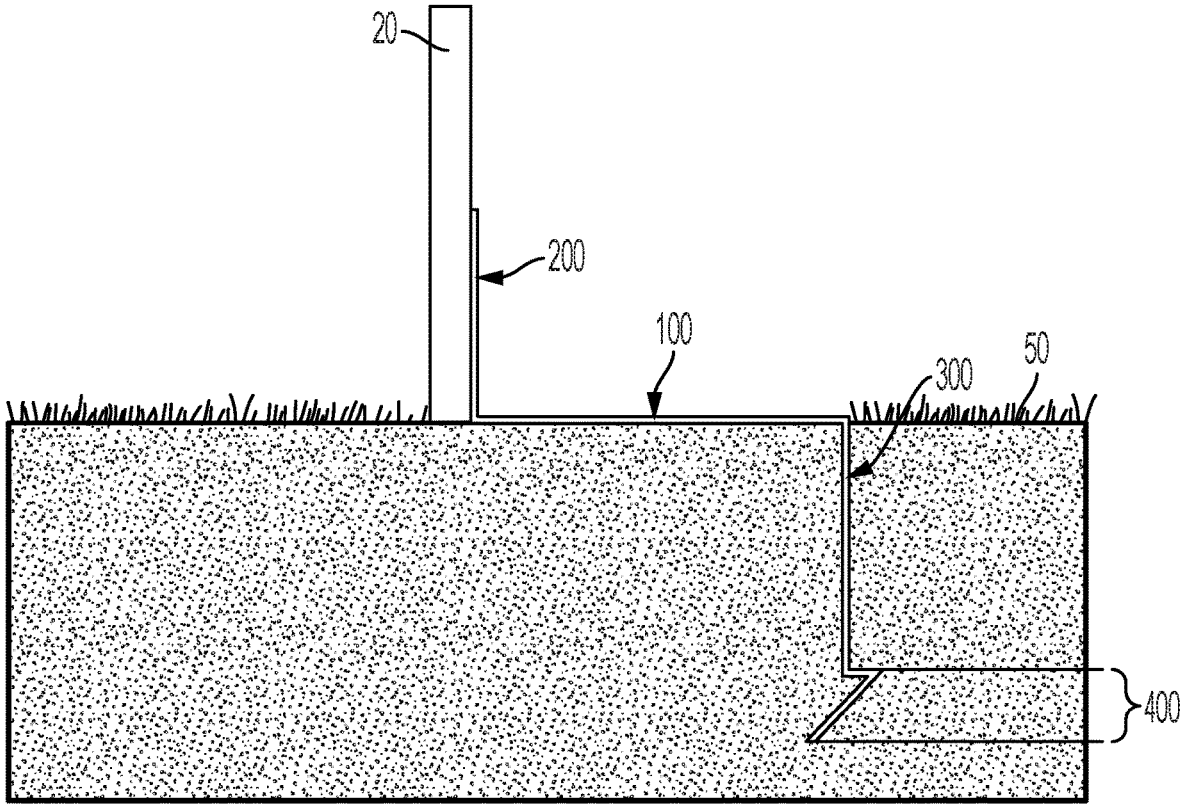
FIG. 6 is a side view of the embodiment of an installed landscaping barrier as described herein.

FIG. 6 depicts a side view of a landscaping barrier (10) as installed. As shown in FIG. 6, when installed, the second longitudinal member (200) is disposed along the bottom portion of the fence (30) while the first longitudinal member (100) is disposed over top of the ground surface (50) and the third longitudinal member (300) is disposed into the trench. Once the third longitudinal member is disposed into the trench, the trench may be re-filled with a material as described above.

Figure 7:
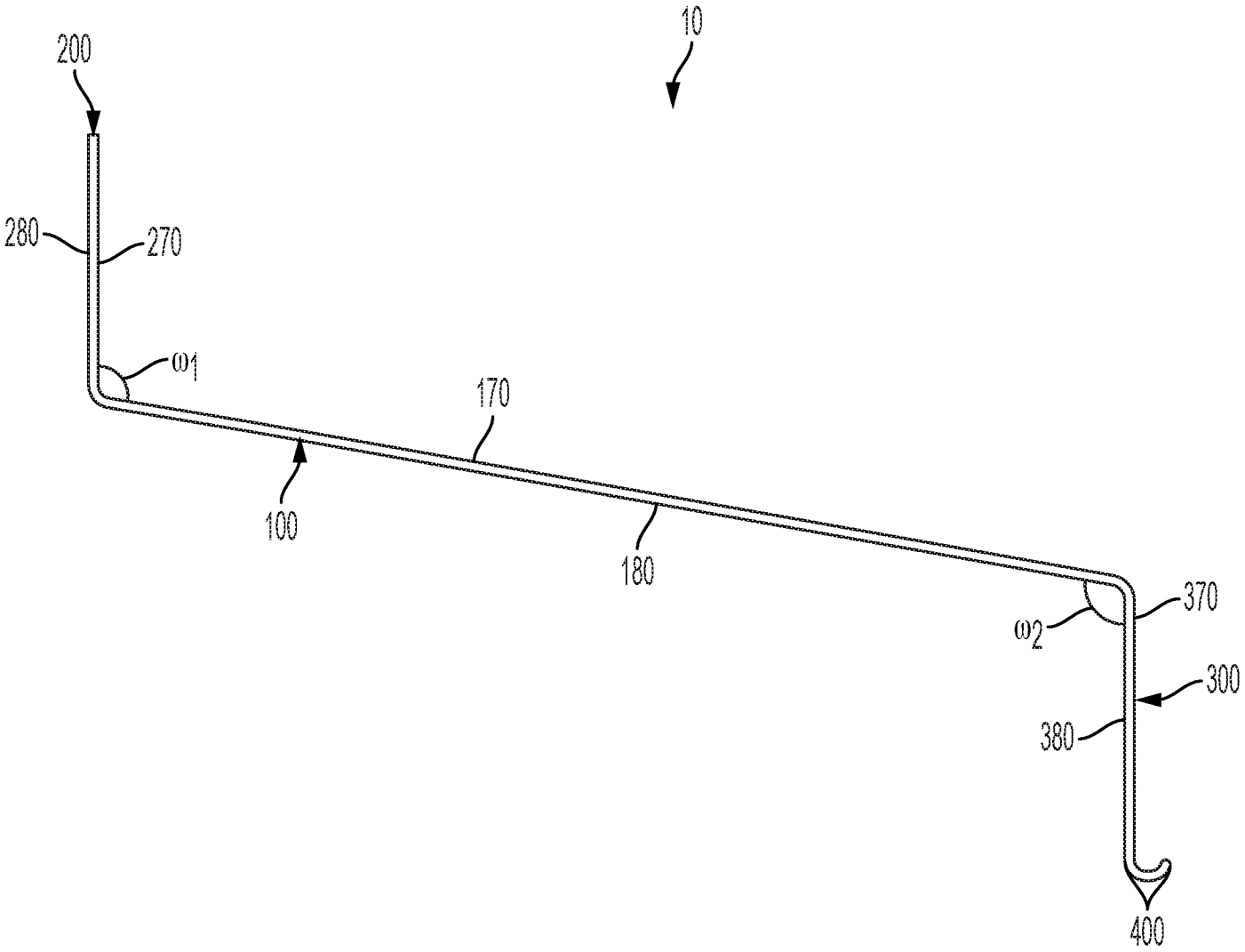
FIG. 7 is a side view of an alternative embodiment of a landscaping barrier.

FIG. 7 depicts a side view of an alternative embodiment of a landscaping barrier (10). As shown in the side view of FIG. 7, the landscaping barrier may comprise the first longitudinal member (100), the second longitudinal member (200), and the third longitudinal member (300). The first longitudinal member may comprise a first longitudinal member top side (170) and a first longitudinal member bottom side (180) opposite the first longitudinal member top side. Similarly, the second longitudinal member may comprise a second longitudinal member top side (270) and a second longitudinal member bottom side (280) opposite the second longitudinal member top side. Finally, the third longitudinal member may comprise a third longitudinal member top side (370) and a third longitudinal member bottom side (380).

In the FIG. 7 embodiment, there is a first bend angle ($\omega_1$) between the first longitudinal member (100) and the second longitudinal member (200). While the embodiments shown in FIG. 1 to FIG. 6 have a first bend angle of approximately 90°, the first bend angle in the FIG. 7 embodiment is greater than 90°. In certain alternative embodiments, the first bend angle may also be less than 90°. The preferred first bend angle will be in a range selected from the group consisting of between 70° and 110°, between 70° and 100°, between 70° and 90°, between 80° and 110°, between 80° and 100°, between 80° and 90°, between 90° and 110°, and between 90° and 100°.

In the FIG. 7 embodiment, there is also a second bend angle ($\omega_2$) between the first longitudinal member (100) and the third longitudinal member (300). While the embodiments shown in FIG. 1 to FIG. 6 have a second bend angle of approximately 90°, the second bend angle in the FIG. 7 embodiment is greater than 90°. In certain alternative embodiments, the second bend angle may also be less than 90°. The preferred second bend angle will be in a range selected from the group consisting of between 70° and 110°, between 70° and 100°, between 70° and 90°, between 80° and 110°, between 80° and 100°, between 80° and 90°, between 90° and 110°, and between 90° and 100°.

FIG. 7 also shows an alternative embodiment of an anchor (400). In the FIG. 7 embodiment, the anchor is in the form of a semi-circle "hook" extending from the first edge of the third longitudinal member.

The landscaping barrier may be comprised of a material selected from the group consisting of polymers, rubbers, and fiber mats. The material from which the landscaping barrier is made may have a thickness in a range selected from the group consisting of between 0.090 inches and 0.160 inches, between 0.090 inches and 0.140 inches, between 0.090 inches and 0.120 inches, between 0.100 inches and 0.160 inches, between 0.100 inches and 0.140 inches, and between 0.100 inches and 0.120 inches. In some embodiments, the material may comprise a UV blocker. Examples of UV blockers include ultraviolet absorbers, quenchers, hindered amine light stabilizers, and combinations thereof. Examples of ultraviolet absorbers include carbon black, rutile titanium oxide, hydroxybenzophenone, hydroxyphenylbenzotriazole, oxanilides, benzophenones, benzotriazoles, and hydroxyphenyltriazines. Examples of quenchers include nickel quenchers. Examples of hindered amine light stabilizers include molecules having a 2,2,6,6-tetramethylpiperidine ring structure.

While the description of the landscaping barrier herein refers to installation of the landscaping barrier along a fence, one of ordinary skill will recognize that the landscaping barrier may be installed along any number of structures. For instance, the landscaping barrier may be installed along a structure selected from the group consisting of a fence, a wall of a commercial building, a wall of a residential building, a wall of an industrial building, a retaining wall, a landscaping bed, and combinations thereof. Regardless of the type of structure, the second longitudinal member (200) may be disposed along the bottom surface of the structure.

The landscaping barrier may be manufactured using a variety of manufacturing techniques. A preferred method of manufacturing the landscaping barrier comprises extruding a flat landscaping barrier blank. The flat landscaping barrier blank will have a landscaping barrier blank length and a landscaping barrier blank width which define a landscaping barrier blank plane. The landscaping barrier blank will also have a landscaping barrier blank first edge, a landscaping barrier blank second edge extending perpendicular or substantially perpendicular from a first end of the landscaping barrier blank first edge, a landscaping barrier blank third edge parallel to the landscaping barrier blank first edge, and a landscaping barrier blank fourth edge extending perpendicular or substantially perpendicular from a second end of the landscaping barrier blank third edge.

Once the flat landscaping barrier blank is extruded, a first score mark may be placed along a first boundary line. The first boundary line will span a distance between the landscaping barrier blank second edge and the landscaping barrier blank fourth edge, and will preferably run parallel to both the landscaping barrier blank first edge and the landscaping barrier blank third edge. The first boundary line will be located at a first distance from the landscaping barrier blank first edge. The first score mark may be added during the process of extruding the flat landscaping barrier blank, or subsequent to extruding the flat landscaping barrier blank.

Also, a second score mark may be placed along a second boundary line. The second boundary line will span a distance between the landscaping barrier blank second edge and the landscaping barrier blank fourth edge, and will preferably run parallel to both the landscaping barrier blank first edge and the landscaping barrier blank third edge. The second boundary line will be located at a second distance from the landscaping barrier blank first edge which is greater than the first distance of the first boundary line. The second score mark may be added during the process of extruding the flat landscaping barrier blank, or subsequent to extruding the flat landscaping barrier blank.

Once the first score mark and the second score mark are placed along their corresponding boundary lines, the landscaping barrier blank may be folded in a first fold direction along the first boundary line and in a second direction which is opposite of the first fold direction along the second boundary line. Preferably the first fold will extend to a first fold angle which is approximately 90° relative to the landscaping barrier blank plane. Similarly, the second fold will preferably extend to a second fold angle which is approximately 90° relative to the landscaping barrier blank plane.

An alternative manufacturing technique for manufacturing the landscaping barrier is vacuum forming. Vacuum forming involves heating a sheet of plastic material to a forming temperature, and then stretching the sheet of plastic into a single-surface mold. The sheet of plastic is forced against the single surface mold by a vacuum. Once the sheet of plastic is formed into the single-surface mold, the plastic is allowed to cool and solidify. The specific temperature to which the sheet of plastic material is heated to allow the vacuum to force the plastic into the single-surface mold will depend upon a number of factors well known to one of ordinary skill. These factors include the type of plastic and the thickness of the plastic material.

In the vacuum forming manufacturing technique, the single-surface mold will preferably have a profile which mirrors the specific geometry (length, width, height, and bend angle) of the various components of the landscaping barrier. For example, the single-surface mold may include a profile for the first longitudinal member, the second longitudinal member, the third longitudinal member, the first bend angle between the first longitudinal member and the second longitudinal member, the second bend angle between the first longitudinal member and the third longitudinal member, and the anchor.

The landscaping barrier (10) comprising the first longitudinal member (100), the second longitudinal member (200), and the third longitudinal member (300) may be installed along a structure using the following steps. One step may include digging a trench (70) parallel to the structure at a distance from the structure equal to or substantially equal to the first longitudinal member width dimension (120). The trench may be dug using a variety of equipment including—but not limited to—a trench saw, a shovel, or a back hoe.

A second step may include inserting the third longitudinal member (300) into the trench (70). The third longitudinal member may have a third longitudinal member width dimension (320) and a third longitudinal member thickness. Preferably, the trench is dug to a trench depth (75) which is greater than or equal to the third longitudinal member width dimension thereby allowing the entirety of the third longitudinal member to be inserted into the trench. Preferably, the trench is also dug to a trench width (77) which is greater than or equal to the third longitudinal member thickness. The third longitudinal member may or may not comprise an anchor (400) attached to and extending from the first edge of the third longitudinal member (330).

A next step may include placing the first longitudinal member (100) along a ground surface (50). The ground surface preferably spans the distance from the trench (70) to the structure. This step may be conducted subsequent to, simultaneously with, or before the step of inserting the third longitudinal member into the trench.

A next step may include placing the second longitudinal member (200) along a bottom portion of the structure. This step may be conducted subsequent to, simultaneously with, or before the step of placing the first longitudinal member along the ground surface. Once placed along the bottom portion of the structure, the second longitudinal member may be secured to the bottom portion of the structure using a plurality of fasteners. Each fastener of the plurality of fasteners may independently be selected from the group consisting of a wire, a cable tie, a nut and bolt, a screw, a rivet, and a staple.

The next step may include filling the trench with a filling material. The filling material may be selected from the group consisting of dirt, sand, gravel, asphalt, concrete, or combinations thereof.

While the installation method described above may be conducted on one side of a free-standing structure such as a fence or retaining wall, one or ordinary skill will recognize that the installation method may be conducted on both sides of the free-standing structure. For instance, in some embodiments, there may be a first landscaping barrier installed on a first side of the free-standing structure according to the method described above, and a second landscaping barrier installed on a second side of the free-standing structure which is opposite the first side of the free-standing structure according to the method described above.

In embodiments where there is a first landscaping barrier installed on a first side of a free-standing structure, and a second landscaping barrier installed on a second side of a free-standing structure, there may be a gap material placed between the second longitudinal member bottom side of the first landscaping barrier and the second longitudinal member bottom side of the second landscaping barrier. The gap material may serve to reduce or prevent vegetation growth between the first and second landscaping barriers. Preferably the gap material will not be soil, dirt, sand, or gravel. One preferred gap material is a spray polyurethane foam.

What is claimed is:

1. A landscaping barrier (10) comprising:

a first flat planar member (100) adjacent a ground surface, said first flat planar member having a first flat planar member length dimension (110), a first flat planar member width dimension (120), and at least four first flat planar member edges;

a second flat planar member (200) adjacent a fence or wall, said second flat planar member having a second flat planar member length dimension (210), a second flat planar member width dimension (220), and at least four second flat planar member edges;

a third flat planar member (300) having a third flat planar member length dimension (310), a third flat planar member width dimension (320), and at least four third flat planar member edges; and an anchor (400) for receiving a filling material selected from the group consisting of dirt, sand, gravel, asphalt, concrete, and combinations thereof to hold at least a portion of the landscaping barrier in the ground, said anchor being attached to and extending from a first edge of the third flat planar member (330), said anchor comprising a first flat anchor member extending substantially perpendicular from the first edge of the third flat planar member in a direction opposite the first flat planar member for receiving the filling material, and a second flat anchor member extending from the first flat anchor member; and wherein a first edge of the second flat planar member (230) is attached to and extends substantially perpendicular from a third edge of the first flat planar member (150), and a third edge of the third flat planar member (350) is attached to and extends substantially perpendicular from a first edge of the first flat planar member (130) which is opposite of the third edge of the first flat planar member with the third flat planar member extending in the opposite direction of the second flat planar member; and wherein the first flat planar member does not include a fence post hole, and the second flat planar member does not include a cut-out in the second flat planar member.

2. The landscaping barrier of claim 1, wherein a first bend angle ($\omega_1$) between the first flat planar member and the second flat planar member is in a range of between 70° and 110°.

3. The landscaping barrier of claim 1, wherein a second bend angle ($\omega_2$) between the first flat planar member and the third flat planar member is in a range of between 70° and 110°.

4. The landscaping barrier of claim 3, wherein a first bend angle ($\omega_1$) between the first flat planar member and the second flat planar member is in a range of between 70° and 110°.

5. The landscaping barrier of claim 1, wherein the anchor extends along the entire first edge of the third flat planar member.

6. The landscaping barrier of claim 1, wherein the landscaping barrier is comprised of a material selected from the group consisting of polymers, rubbers, and fiber mats.

7. The landscaping barrier of claim 6, wherein the barrier material comprises a UV blocker.

8. A method of installing a landscaping barrier (10) comprising a first flat planar member (100), a second flat planar member (200), a third flat planar member (300), and an anchor (400) comprising a first flat anchor member and a second flat anchor member along an edge of a structure comprising the steps of:

a. digging a trench (70) parallel to the structure at a distance from the structure substantially equal to a first flat planar member width dimension (120), b. inserting the third flat planar member into the trench, c. placing the first flat planar member along a ground surface (50) spanning the distance from the trench to the structure, d. placing the second flat planar member along a bottom portion of the structure, e. securing the second flat planar member to the bottom portion of the structure using a plurality of fasteners, and f. filling the trench with a filling material;

wherein the third flat planar member has a third flat planar member width dimension (320) and a third flat planar member thickness, the trench is dug to a trench depth (75) which is greater than or equal to the third flat planar member width dimension, and the trench is dug to a trench width (77) which is greater than or equal to the third flat planar member thickness; and wherein a first edge of the second flat planar member (230) is attached to and extends substantially perpendicular from a third edge of the first flat planar member (150), and a third edge of the third flat planar member (350) is attached to and extends substantially perpendicular from a first edge of the first flat planar member (130) which is opposite of the third edge of the first flat planar member with the third flat planar member extending in the opposite direction of the second flat planar member;

wherein the first flat anchor member extends substantially perpendicular from a first edge of the third flat planar member (330) in a direction opposite the first flat planar member for receiving the filling material;

wherein the second flat anchor member extends from the first flat anchor member; and wherein the first flat planar member does not include a fence post hole, and the second flat planar member does not include a cut-out in the second flat planar member.

9. The method of claim 8, wherein each fastener of the plurality of fasteners is independently selected from the group consisting of a wire, a cable tie, a nut and bolt, a screw, a rivet, and a staple.

10. The method of claim 8, wherein the filling material is selected from the group consisting of dirt, sand, gravel, asphalt, concrete, or combinations thereof.

11. The method of claim 8, wherein the structure is selected from the group consisting of a fence, a wall of a commercial building, a wall of a residential building, a wall of an industrial building, a retaining wall, a landscaping bed, and combinations thereof.

* * * * *